United States Patent [19]

Nguyen et al.

[11] Patent Number: 4,499,974

[45] Date of Patent: Feb. 19, 1985

[54] TERMINAL SLOWDOWN SPEED PATTERN GENERATOR

[75] Inventors: Tac H. Nguyen, Denville; Alan L. Husson, Hackettstown, both of N.J.

[73] Assignee: Westinghouse Electric Corp., Pittsburgh, Pa.

[21] Appl. No.: 527,886

[22] Filed: Aug. 30, 1983

[51] Int. Cl.[3] ..... B66B 5/06

[52] U.S. Cl. ..... 187/29 R

[58] Field of Search ..... 187/29

[56] References Cited

U.S. PATENT DOCUMENTS

| | | | |
|---|---|---|---|
| 3,779,346 | 12/1973 | Winkler | 187/29 |
| 4,161,236 | 7/1979 | Husson | 187/29 |
| 4,225,015 | 9/1980 | Yamada | 187/29 |
| 4,318,456 | 3/1982 | Lowry | 187/29 |

*Primary Examiner*—J. V. Truhe
*Assistant Examiner*—W. E. Duncanson, Jr.
*Attorney, Agent, or Firm*—D. R. Lackey

[57] ABSTRACT

Methods and apparatus for providing a desired terminal slowdown speed pattern as an elevator car approaches a terminal floor in the terminal slowdown zone. Markers are fixedly spaced in the zone, with their spacing being a direct function of their distance from the terminal floor. The markers are detected as the elevator car proceeds past them towards the terminal floor, and a train of signals T are produced having values responsive to the marker-to-marker time, i.e., the elapsed time between successive detections of markers. The velocity V of the elevator car is also detected, and the terminal slowdown speed pattern is provided as a function of the product of V and T, as scaled by a constant which includes the square root of the desired deceleration rate.

16 Claims, 6 Drawing Figures

TERMINAL SLOWDOWN SPEED PATTERN GENERATOR

BACKGROUND OF THE INVENTION

1. Field of the Invention

The invention relates in general to speed pattern generators, and more specifically to new and improved terminal slowdown speed pattern generators for elevator systems.

2. Description of the Prior Art

Elevator systems employ a redundant, independent means for detecting an overspeed condition of an elevator car as it approaches a terminal floor. If a first overspeed condition is detected, an auxiliary terminal slowdown speed pattern is generated which is substituted for the normal slowdown speed pattern. If this action fails to slow down the car properly, an emergency terminal stop is initiated. The present invention concerns the development of the auxiliary terminal slowdown speed pattern.

One prior art arrangement utilizes a cam driven distance sensor located on the elevator car to generate the auxiliary terminal speed pattern as it is actuated by a cam in the hoistway. Since the deflection of the distance sensor's arm is small compared with the distance required to slow down the elevator car, it is often necessary to resort to two cams and two sensors in high speed elevator systems.

An improved arrangement for developing an auxiliary terminal slowdown speed pattern is disclosed in U.S. Pat. No. 3,779,346, which is assigned to the same assignee as the present application. In this patent, the terminal slowdown control includes spaced indicia or markers, such as may be provided by a notched blade, and a detector. The markers and detector are mounted such that there is relative movement between them as the elevator car approaches a terminal floor. The notched blade is preferably mounted in the hoistway, and the detector is preferably mounted on the elevator car such that it is aligned with the blade and will detect the spaced teeth on the blade as it passes them.

The markers or teeth on the blade are spaced to provide the desired speed profile for bringing the elevator car to a stop at the associated terminal floor. They are spaced successively closer together in the direction of the terminal, such that the time required for the elevator car to pass between any adjacent pair will be a predetermined constant if the deceleration rate of the car is constant, and at the desired magnitude. If the time elapsed between adjacent pairs is shorter than a predetermined value, monitoring means, including means for converting the elapsed time to a speed error signal, will detect the overspeed and initiate slowdown, i.e., the switching from the usual speed pattern to an auxiliary speed pattern.

The spaced markers, and detector, along with the means for converting the elapsed time between the spaced markers to a speed error signal used for the monitoring function, are also used to generate the auxiliary speed pattern. The speed error signal is summed with a signal responsive to the speed of the elevator car, such as a signal from a tachometer responsive to the elevator drive motor, to provide the required slowdown speed pattern profile.

While this arrangement provides an excellent auxiliary terminal slowdown speed pattern, the speed error signal is limited in the amount of correction it can apply to the signal responsive to car speed. In other words, the auxiliary terminal slowdown speed pattern signal provided by this arrangement is not a full range signal, and will provide the correct speed pattern only as long as the car speed is reducing within the range of correction of the speed error signal. If the car speed is outside this correctable range, an emergency terminal stop will be triggered. It would be desirable to provide a new and improved terminal slowdown speed pattern generator which provides a full range signal, enabling the correct auxiliary terminal slowdown speed pattern to be generated regardless of car speed. A full range signal will also have the advantage of being usable in a pattern clamp arrangement, such as disclosed in U.S. Pat. No. 4,161,235 and co-pending application Ser. No. 356,684, filed Mar. 10, 1982, entitled "Elevator System", which are both assigned to the same assignee as the present application.

The auxiliary terminal slowdown speed pattern of the arrangement disclosed in the subject patent is also generated by primarily analog circuitry utilizing RC circuits for timing. It would also be desirable to provide a new and improved terminal slowdown speed pattern generator which utilizes digital signals whenever possible for accuracy and ease of adjustment, and which does not depend upon RC timing circuits in the critical areas of pattern development.

SUMMARY OF THE INVENTION

Briefly, the present invention develops a terminal slowdown speed pattern from spaced indicia or markers in each terminal slowdown zone, such as may be provided by a notched blade. The markers are spaced as a direct function of their distance from the associated terminal floor. Instead of correcting a major signal with a value limited error signal in a summing amplifier, the present invention generates the auxiliary terminal slow down speed pattern as a function of the product of two variable signals V and T. Signal T is a train of signals which, in the preferred embodiment, is digital in form, with each signal T having a value indicative of a marker-to-marker time, i.e., the time required for the elevator car to pass between two adjacent markers. Signal V is the speed of the elevator car at the time each signal T is generated. The product of the signals V and T is scaled by a constant which includes the square root of the desired constant deceleration rate.

In a preferred embodiment, the timing is provided by a crystal controlled oscillator, eliminating RC timing circuits in the production of the speed pattern, and the time T is in the form of a digital count value which is applied to the digital input of a multiplying digital-to-analog (D/A) converter. The car speed V is an analog signal, properly scaled by a predetermined constant which takes into account the desired deceleration rate and the scaling of the signal T, and this analog signal is applied to the reference voltage input of the D/A converter. Thus, signal V is multiplied by the value of the digital signal T to produce the desired analog terminal slowdown speed pattern at the output of the D/A converter.

BRIEF DESCRIPTION OF THE DRAWINGS

The invention may be better understood, and further advantages and uses thereof more readily apparent, when considered in view of the following detailed description of exemplary embodiments, taken with the accompanying drawings, in which.

DESCRIPTION OF THE PREFERRED EMBODIMENTS

Figures 1, 2:
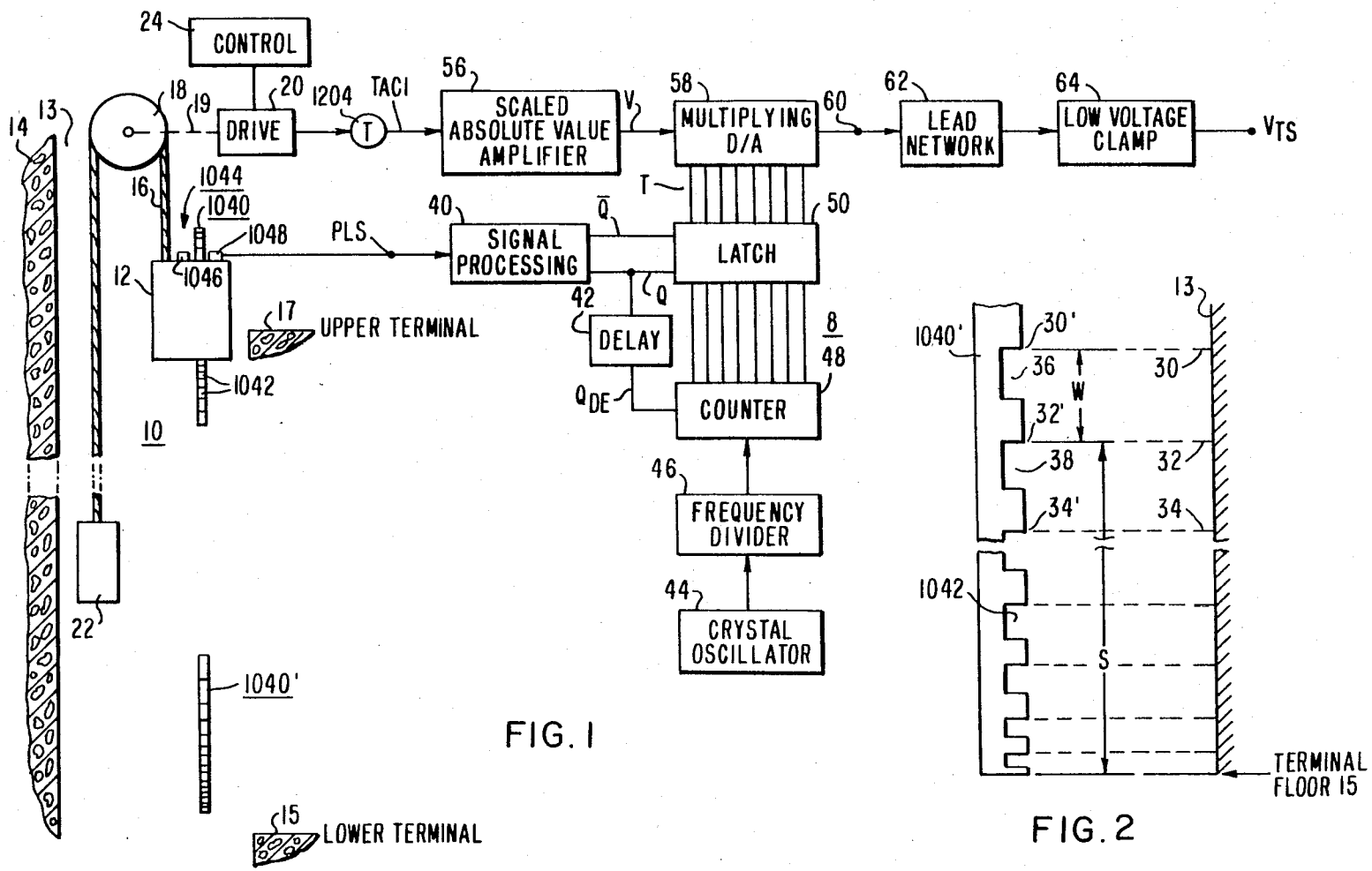
FIG. 1 is a partially schematic and partially block diagram illustrating a speed pattern generator for an elevator system, which speed pattern generator is constructed according to the teachings of the invention.
FIG. 2 is a diagram which illustrates spaced indicia or markers in the terminal slowdown zone of an elevator hoistway, and an easily constructed and installable blade having teeth constructed to function as spaced markers.

Referring now to the drawings, and to FIG. 1 in particular, there is shown a terminal slowdown speed pattern generator 8 for an elevator system 10. If a more detailed showing of an elevator system is desired, as well as apparatus for producing terminal overspeed signals for initiating substitution of the terminal slowdown speed pattern for the normal speed pattern, reference may be had to the hereinbefore-mentioned U.S. Pat. No. 3,779,346, which is hereby incorporated into the specification of the present application by reference.

Elevator system 10 includes an elevator car 12 mounted in a hoistway 13 for movement relative to a building or structure 14 having a plurality of floors or landings. Only the lower and upper terminal floors, indicated by reference numerals 15 and 17, respectively, are shown in order to simplify the drawing. The elevator car 12 is supported by a plurality of wire ropes 16 which are reeved over a traction sheave 18 mounted on the shaft 19 of a traction drive machine 20. A counterweight 22 is connected to the other ends of the ropes 16. The control for operating the drive machine 20, including the motor controller, the normal speed pattern generator, distance slowdown control, and floor selector, are all shown generally in block function 24. The incorporated U.S. Pat. No. 3,779,346 may be referred to for details of such control.

The distance slowdown portion of control 24 provides the normal speed pattern for decelerating and stopping the elevator car 12 at a terminal floor, as well as at the intermediate floors. The redundant and independent terminal slowdown control is provided by a combination of pick-up means 1044 and spaced indicium or marker means. The pick-up means 1044 is mounted on the elevator car, and the spaced marker means, which may be in the form of elongated plates or blades 1040 and 1040', are disposed adjacent to the upper and lower terminal floors 17 and 15, respectively. The blades 1040 and 1040', in order to function as spaced markers, are provided with notches, holes, or openings 1042. The blades define a terminal slowdown zone adjacent to each terminal floor.

The notches or openings 1042 are oriented such that the pick-up means 1044 on the elevator car 12 can detect their presence and initiate a pulse train PLS in the form of a square wave which is utilized by the terminal slowdown speed pattern generator 8.

The pick-up means 1044 may be of any suitable type, such as optical or magnetic. For example, if it is the optical type, a source 1046 of electromagnetic radiation is directed towards a receiver 1048 of such radiation, with the discontinuities 1042 of the blade 1040 passing between the source and receiver when the car is traveling in the hoistway adjacent to a terminal floor. The receiver 1048 includes means for generating pulses which create a square wave, as the discontinuities of the blade 1040 and the pick-up means 1044 move relative to one another, with this signal being applied to the input terminal PLS of the terminal slowdown speed pattern generator 8.

In the present invention, the spaced indicia or markers in each of the terminal zones are spaced from one another as a direct function of their distance from the associated terminal, according to the following relationship:

$$W=\sqrt{S/16} \tag{1}$$

where:

W = the spacing between two adjacent markers

S = the distance of the closer of the two adjacent markers to the terminal floor.

This relationship may be more easily understood with reference to FIG. 2, which illustrates a portion of the terminal slowdown zone associated with the lower terminal floor 15. Markers, such as markers 30, 32 and 34, are spaced apart in the slowdown zone. The slowdown blade 1040' of FIG. 1 is also illustrated in order to show how the slowdown blade 1040' functions as the markers, and also how the spacing W extends from the start 30' of one notch 36 to the start 32' of the next adjacent notch 38. When determining the spacing W between the start 30' of notch 36 and the start 32' of notch 38, the distance S is the distance from the start 32' of notch 38 to the terminal floor 15, as shown in FIG. 2.

The desired terminal slowdown speed pattern $V_{TS}$ may be expressed as a function of S as:

$$V_{TS}=\sqrt{2AS} \tag{2}$$

where: A = desired deceleration rate

Combining equations (1) and (2) provides the following:

$$V_{TS}=16W\sqrt{2A} \tag{3}$$

The time T for the elevator car to traverse the spacing W at an average velocity V may be expressed as:

$$T=W/V \tag{4}$$

Since the car velocity across any given space W of the slowdown blade 1040' will change by only a very small amount, negligible error is introduced in assuming that the car speed at the completion of a spacing W is equal to the average car speed across the spacing W.

Therefore, equations (4) and (3) may be combined to provide the following:

$$V_{TS}=VT16\sqrt{2A} \tag{5}$$

where:

$V_{TS}$ = desired terminal slowdown speed;

V = car speed at the end of each spacing W;

T = time for the elevator car to traverse each spacing W;

A = desired terminal slowdown deceleration rate.

Since the term $16\sqrt{2A}$ is a constant, it will be noted that the desired terminal slowdown speed pattern $V_{TS}$ may be generated by multiplying the two variable quantities V and T. This is unlike the prior art arrangement which summed an error signal and the car velocity to provide the terminal slowdown speed pattern. The pattern produced by implementing equation (5) is a full range signal which inherently collapses as the car approaches a terminal floor, which is also unlike the prior art summing arrangement in which the amount of correction provided by the error signal is limited. A full range signal also has the advantage of enabling the terminal slowdown speed pattern signal $V_{TS}$ to be used as a variable reference limit signal into the pattern clamp arrangement of U.S. Pat. No. 4,161,235, as taught by the hereinbefore-mentioned co-pending application Ser. No. 356,684. This is an especially desirable arrangement because it automatically provides the functions of detecting car overspeed in a terminal zone and the automatic substitution of the auxiliary terminal slowdown speed pattern for the normal slowdown speed pattern. This substitution is also made without delay when the car speed starts to exceed the reference pattern. Of course, the speed monitoring and pattern substituting arrangements of the incorporated patent may be used, as well as any other overspeed monitoring and pattern substituting arrangements, such as those disclosed in U.S. Pat. Nos. 4,085,823; 4,128,141; and 4,161,236, all of which are assigned to the same assignee as the present application.

Returning now to FIG. 1, the terminal slowdown speed pattern generator 8 provides the terminal slowdown speed pattern $V_{TS}$ in response to the pulse train PLS from the detector 1048 and the signal TAC1 from the tachometer 1204. The pulses PLS are processed in signal processing means 40 which may include a monostable multivibrator, for example, to produce constant width pulses Q and $\overline{Q}$ in response to the square wave defined by the pulses PLS, each time a spacing W is traversed by the elevator car. Signal Q is delayed in delay means 42 to provide a delayed signal $Q_{DE}$. Signals, Q, $\overline{Q}$ and $Q_{DE}$, and their relationships to blade 1040', are set forth in FIG. 3. Since the diagram shown in FIG. 3 necessarily is distance based on its X-axis, because of the inclusion of blade 1040', the times $T_1$, $T_2$, and $T_3$ shown in the Figure for the elevator car to traverse spaces $W_1$, $W_2$ and $W_3$ appear to be unequal, while in actuality, the times $T_1$, $T_2$, $T_3$, etc., are equal when the elevator car is slowing down along the desired slowdown curve. If the actual car speed exceeds the desired value, the time T decreases to maintain the desired pattern $V_{TS}$. If the actual car speed drops below the desired value, the time T increases to maintain the desired pattern $V_{TS}$.

Figure 3:
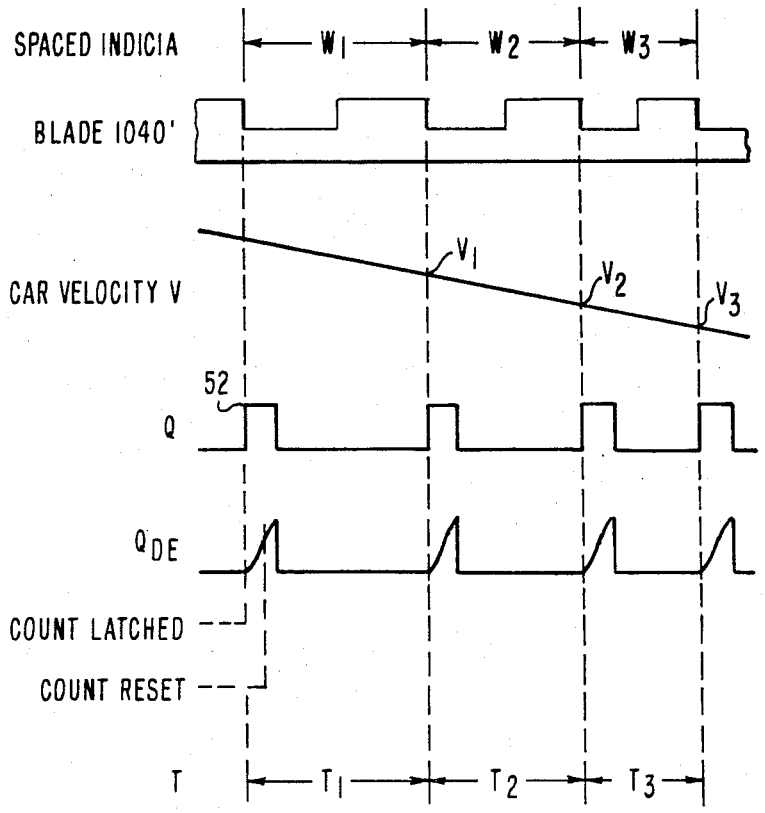
FIG. 3 is a diagram which sets forth certain of the signals and their relationships which are utilized by the speed pattern generator shown in FIG. 1.

The time required for the elevator car to traverse a particular spacing W is measured by allowing a crystal controlled time base to clock a counter. When the traversal of the spacing is complete, the count is frozen by latching the count in a latch. The latched binary number is a highly accurate digital representation of the time T. These functions are implemented in FIG. 1 by a crystal oscillator 44, a frequency divider 46 which scales the oscillator frequency to the desired value, a counter 48, and a latch 50. Latch 50 latches the value of a count applied to its input on the rising edge of a control signal, and it holds this count until the next rising edge of the control signal causes it to latch he next count value. As shown in FIG. 3, latch 50 may latch the count on the rising edge 52 of signal Q, and the delayed signal $Q_{DE}$ may reset the counter to start the count for the next spacing W. Thus, signal $Q_{DE}$ is delayed only long enough to prevent a race between the latching of latch 50 and the resetting of counter 48.

The velocity feedback tachometer 1204 is used to measure the speed of the elevator car. Tachometer 1204 should be a high quality tachometer capable of providing a low-noise analog signal TAC1 representative of the elevator speed. Friction or rim driving the tachometer 1204, such as from the traction sheave 18, instead of having a belt or gear drive, will substantially reduce the electrical noise in the signal TAC1. A suitable rim-drive arrangement is set forth in co-pending application Ser. No. 411,791, filed Aug. 26, 1982, entitled "Tachogenerator", which application is assigned to the same assignee as the present application.

Signal TAC1 is passed through a scaling absolute value amplifier 56, where it is scaled to account for the constant $16\sqrt{2A}$ in equation (5), and to agree with the selected scaling of the quantity T which appears at the output of latch 50.

Figure 4:
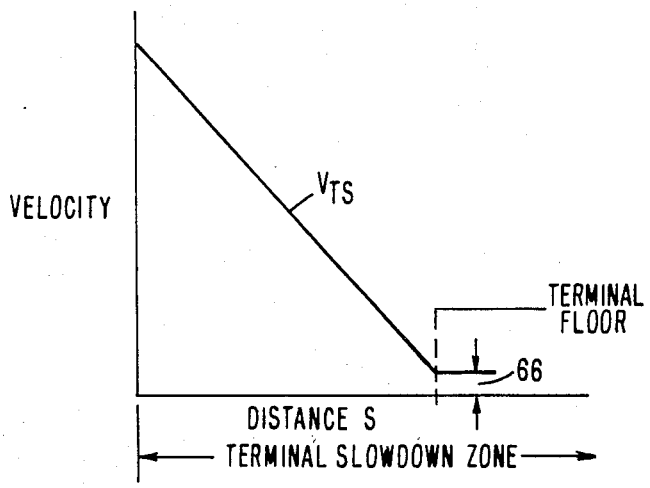
FIG. 4 is a graph illustrating an auxiliary terminal slowdown speed pattern signal $V_{TS}$ produced by the speed pattern generator shown in FIG. 1.

Multiplication of analog signal V and digital signal T, to provide a point on the desired terminal slowdown speed pattern $V_{TS}$ shown in FIG. 4, is accomplished by a multiplying D/A converter 58. Signal V is applied to the "reference" input and the digital count T is applied to the digital input. The output 60 of the D/A converter 58, suitably filtered to connect the curve points and provide a smooth pattern, is the desired terminal slowdown speed pattern.

Since the motor drive system exhibits a fixed time delay in its response, the desired speed at output terminal 60 is processed in a leading network 62 to develop a terminal slowdown speed pattern which takes into account the delay characteristic of the motor drive. Finally, the speed pattern is passed through a clamp circuit 64 which limits the minimum value of the speed pattern. This is done so that the elevator car will not come to a stop short of the terminal floor, and so that the terminal slowdown speed pattern can be used as a clamp on the normal speed pattern. The effect of the clamp 64 on the speed pattern $V_{TS}$ is shown at 66 in FIG. 4.

Figure 5A:
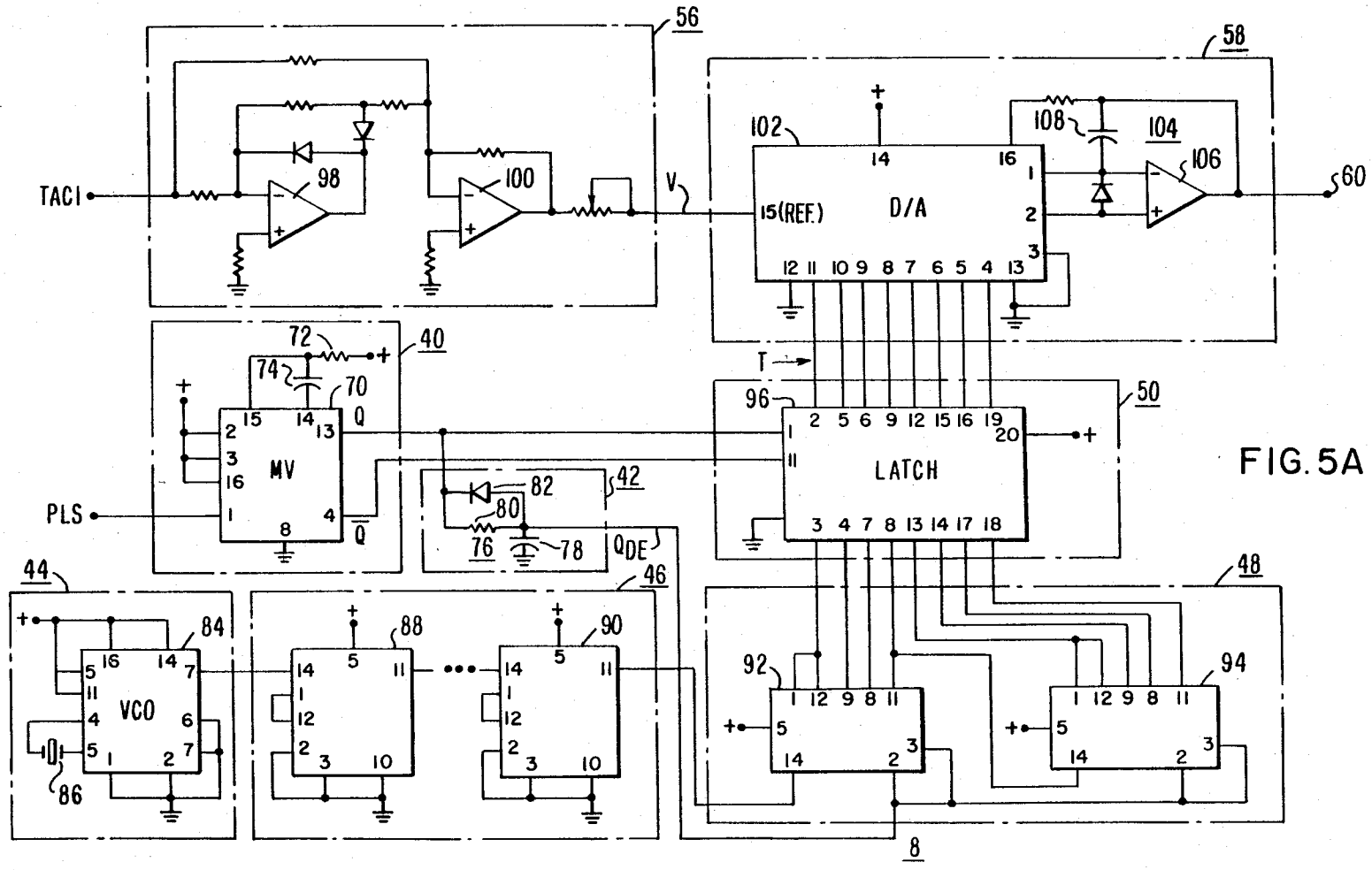
FIGS. 5A and 5B may be assembled to provide a detailed schematic diagram of an exemplary implementation of the functions shown in block form in FIG. 1.
Figure 5B:
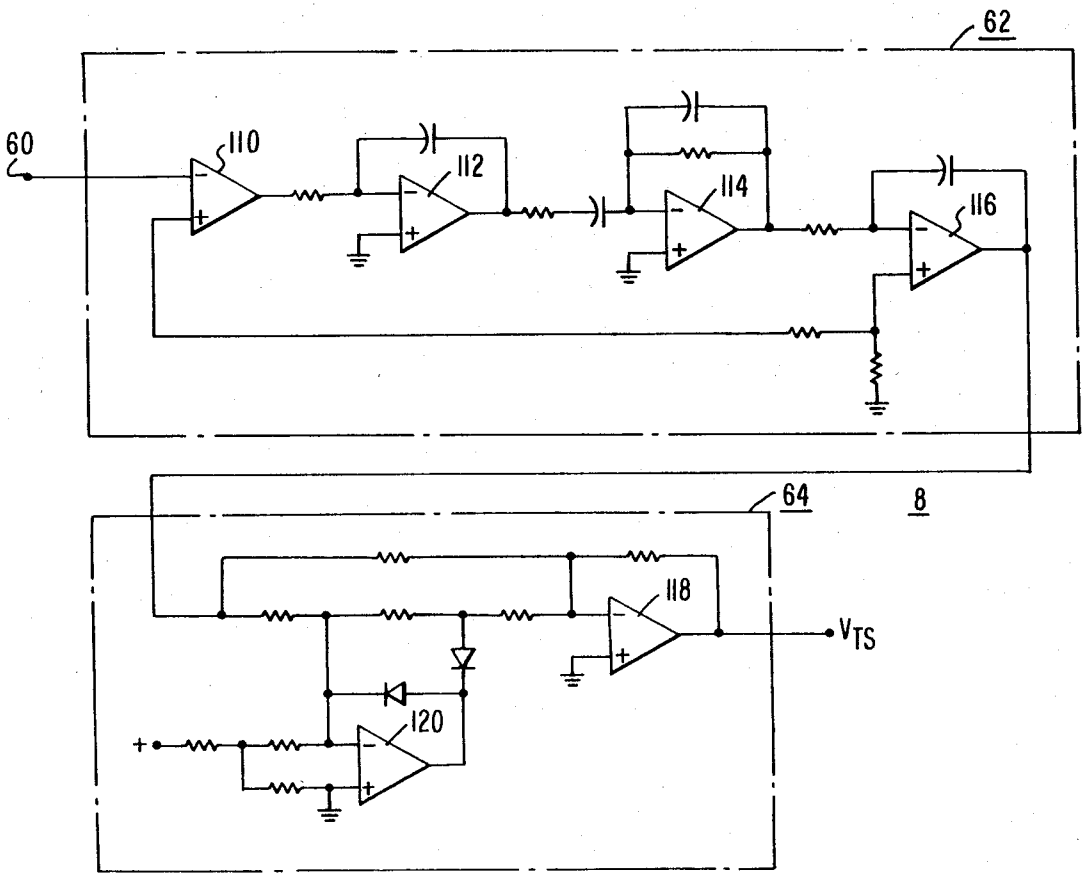

FIGS. 5A and 5B may be assembled to provide a detailed exemplary implementation of the speed pattern generator 8 shown in block form in FIG. 1. The signal processing function 40 may be provided by a monostable multivibrator 70, such as T.I.'s 74S123. The pulse train PLS provides a square wave input for the high level trigger input of multivibrator 70. Resistor 72 and capacitor 74 establish the width of the Q and $\overline{Q}$ output signals.

The delay function 42 may be provided by an RC network 76 comprising a capacitor 78, a resistor 80, and a diode 82. The diode 82 is connected to rapidly discharge capacitor 78 on the completion of a pulse Q.

The crystal oscillator function 44 may be provided by T.I.'s voltage controlled oscillator (VCO) 84, the output frequency of which is controlled by a crystal 86.

The frequency divider function 46 may be provided by a plurality of counters, indicated generally at 88 and 90, such as T.I.'s four-bit binary counter SN 7493. The number of divider stages depends upon the crystal frequency and the desired frequency for clocking the counters. As an example, a 4.4 MHZ crystal and three 16:1 frequency divider stages will provide a frequency of 1074 Hz, which is high enough to provide the requisite accuracy in timing the spacing W.

The counting function 48 may be provided by two 4-bit binary counters 92 and 94, such as the hereinbeforementioned SN7493, connected to provide an 8-bit count.

The latching function 50 may be performed by a latch 96, such as T.I.'s octal transparent latch 74LS373.

The scaling and absolute value function 56 is provided by an operational amplifier (op amp) 98 connected as a precision rectifier, and an op amp 100 connected as an inverting amplifier. The feedback components are selected to provide scaling proportional to the constant $16\sqrt{2A}$ and to accommodate the scaling of the digital signal T.

The multiplying D/A function 58 may be provided by a D/A converter 102, such as analog devices AD 7524. The digital signal T is applied to its digital input, and the analog signal is applied to its reference input. The output is an analog signal which is filtered by a filter arrangement 104 which includes an op amp 106 and a feedback capacitor 108. The filter arrangement 104 "connects" the discrete analog signals which form points on the terminal slowdown speed pattern curve, to provide the smooth speed pattern $V_{TS}$ shown in FIG. 4.

The lead network 62 may be provided by op amps 110, 112, 114 and 116 connected to advance the terminal slowdown speed pattern signal appearing at terminal 60 by the amount of the fixed system time delay.

The low voltage clamping function 64 is provided by an op amp 118 connected as an inverting amplifier, and an op amp 120 connected to provide a fixed DC voltage level selected to provide the clamping magnitude 66 indicated in FIG. 4.

In summary, there has been disclosed a new and improved terminal slowdown speed pattern generator which overcomes certain disadvantages of prior art terminal slowdown speed pattern generators, by spacing indicia or markers in the terminal slowdown zone, which markers are spaced as a direct function of their distance from the terminal floor. The speed pattern is developed in response to the product of the time T required for the elevator car to traverse the space W between two adjacent markers, and the velocity V of the elevator car as it passes the last marker of the space. The time T is digitally developed from a crystal controlled oscillator, with no RC circuits in the development of the signal T. The resulting speed pattern signal is a full range signal which inherently collapses as the elevator car approaches the terminal floor, enabling the signal to be used in a pattern clamp arrangement which automatically switches to the auxiliary speed pattern signal, should the actual speed of the elevator car exceed the auxiliary terminal slowdown speed pattern $V_{TS}$.

We claim as our invention:

1. A speed pattern generator for providing a terminal slowdown speed pattern for an elevator car approaching a terminal floor of a building, comprising:

a plurality of markers spaced along the slowdown approach to the terminal floor, with the spacing being a direct function of the distance of the markers from the terminal floor, first means for detecting said markers as the elevator car approaches the terminal floor, second means responsive to said first means for providing a train of signals T indicative of the marker-to-marker time, third means for providing a signal V responsive to the actual speed of the elevator car, and fourth means for providing a terminal slowdown speed pattern signal which varies as a function of the product of T and V.

2. The speed pattern generator of claim 1 including means for modifying at least one of the signals V and T such that their product is scaled by a predetermined constant which includes the square root of the desired deceleration rate.

3. The speed pattern generator of claim 1 including means for modifying at least one of the signals V and T such that their product is scaled by a constant which includes $16\sqrt{2A}$, with A being the desired deceleration rate.

4. The speed pattern generator of claim 1 wherein the second means provides each signal T in digital form, the third means provides the signal V in analog form, and the fourth means includes a multiplying digital-to-analog converter, wherein the output is an analog signal responsive to the product of a digital input and an analog reference voltage, with the digital signals T providing the digital input, with the analog reference voltage being responsive to the analog signal V, and with the analog output being the terminal slowdown speed pattern signal.

5. The speed pattern generator of claim 1 wherein the fourth means includes compensation means for compensating the terminal slowdown speed pattern signal for the system delay characteristic of the elevator system the speed pattern generator is to be associated with.

6. The speed pattern generator of claim 5 wherein the compensation means includes a lead network.

7. The speed pattern generator of claim 1 wherein the fourth means includes low voltage clamping means for limiting the minimum magnitude of the terminal slowdown speed pattern signal.

8. The speed pattern generator of claim 1 wherein the fourth means includes compensating means for compensating the terminal slowdown speed pattern signal for the time delay characteristic of the elevator system the speed pattern generator is to be associated with, and low voltage clamping means for limiting the minimum magnitude of the terminal slowdown speed pattern signal.

9. The speed pattern generator of claim 1 wherein the first means provides a detection signal each time a marker is detected, and the second means includes oscillator means, counter means, and latch means, with the counter means counting the number of oscillations provided by said oscillator means between successive detection signals, and with said latch means latching each such count to provide the signals T.

10. The speed pattern generator of claim 9 wherein the first means includes signal processing for providing a fixed width pulse in response to each detection signal, with the latch means being set in response to a predetermined edge of the fixed width pulse, and including delay means for delaying said pulses to provide reset signals for said counter means immediately following the setting of the latch means.

11. The speed pattern generator of claim 1 wherein the detector means provides a detection signal each time a marker is detected, and the second means includes crystal oscillator means, frequency divider means for dividing the output frequency of the crystal oscillator means, counter means, and latch means, with the counter means counting the output oscillations provided by said frequency divider means between successive detection signals, and with said latch means latching each such count to provide the signals T.

12. A method of generating a desired terminal slowdown speed patern for an elevator car approaching a terminal floor in the terminal slowdown zone, comprising the steps of:

providing spaced markers in the terminal slowdown zone whose spacing is a direct function of their distance from the terminal floor, providing a signal V responsive to the actual speed of the elevator car in the terminal slowdown zone, providing a train of signals T responsive to the marker-to-marker time of the elevator car, and providing a speed pattern as a function of the product of V and T.

13. The method of claim 12 wherein the step of providing the speed pattern includes the step of scaling the product of V and T with a constant which includes the square root of the desired deceleration rate.

14. The method of claim 12 wherein the step of providing the speed pattern includes the step of scaling the product of V and T with a constant which includes 16 $\sqrt{2A}$, where A is the desired deceleration rate.

15. The method of claim 12 wherein the step of providing the train of signals T provides such signals in digital form, the step of providing the signal V provides the signal in analog form, and the step of providing the speed pattern includes the step of providing a multiplying digital-to-analog converter in which the signals T provide the digital input, the signal V provides a variable analog reference voltage, and the output provides the terminal slowdown speed pattern in analog form.

16. The method of claim 15 including the step of scaling signal V with a constant which includes the square root of the desired deceleration rate, prior to its being used as the reference voltage.

* * * * *